US008944671B2

(12) United States Patent
Son

(10) Patent No.: US 8,944,671 B2
(45) Date of Patent: Feb. 3, 2015

(54) MIXING DEVICE

(75) Inventor: In-Hyuk Son, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 945 days.

(21) Appl. No.: 12/685,535

(22) Filed: Jan. 11, 2010

(65) Prior Publication Data

US 2010/0300561 A1 Dec. 2, 2010

(30) Foreign Application Priority Data

May 29, 2009 (KR) ..... 10-2009-0047348

(51) Int. Cl.
*B01F 5/02* (2006.01)
*B01F 3/08* (2006.01)
*B01F 5/00* (2006.01)

(52) U.S. Cl.
CPC ..... *B01F 3/0873* (2013.01); *B01F 5/0256* (2013.01); *B01F 2005/0037* (2013.01); *B01F 2005/0054* (2013.01); *B01F 2215/0088* (2013.01)
USPC ..... 366/162.4; 239/418; 239/419

(58) Field of Classification Search
CPC ..... B01F 5/0256; B01F 5/0262
USPC ..... 366/162.4; 239/418, 419, 421, 419.5, 239/427
See application file for complete search history.

(56) References Cited

U.S. PATENT DOCUMENTS 902,858 A * 11/1908 Cooke et al. ..... 99/452
1,092,785 A * 4/1914 Stene et al. ..... 239/419
2,751,425 A * 6/1956 Rupp ..... 585/716
2,770,501 A 11/1956 Coanda
2,976,024 A * 3/1961 Martinek ..... 366/162.4
4,934,445 A * 6/1990 Plata et al. ..... 164/486
5,435,913 A * 7/1995 Ashbrook ..... 210/188
5,772,930 A 6/1998 Hashimoto et al.
6,790,427 B2 9/2004 Charles et al.
2004/0026528 A1* 2/2004 Jenkins ..... 239/11
2004/0089235 A1 5/2004 Yamada et al.
2005/0211168 A1 9/2005 Yamada et al.

(Continued)

FOREIGN PATENT DOCUMENTS

CN 1520378 A 8/2004
DE 714517 11/1941
DE 714 517 12/1941

(Continued)

OTHER PUBLICATIONS

KIPO Notice of Allowance dated Apr. 8, 201 for Korean Priority Application No. 10-2009-0047348.

(Continued)

*Primary Examiner* — David Sorkin
(74) *Attorney, Agent, or Firm* — Christie, Parker & Hale, LLP

(57) ABSTRACT

A mixing device capable of mixing a variety of fluids and suitable for miniaturization and low cost operation. In one embodiment, a mixing device includes a housing having an inner space and at least one opening for allowing at least two kinds of fluids to flow into the inner space, at least one pair of nozzle holes passing through one side wall of the housing, and at least one pair of guide portions extending from an outer surface of the housing and protruding up to the respective nozzle holes so that mixed fluids respectively discharged through the at least one pair of nozzle holes collide with each other.

14 Claims, 7 Drawing Sheets

(56) References Cited

U.S. PATENT DOCUMENTS

| | | | |
|---|---|---|---|
| 2008/0309708 | A1 | 12/2008 | Teshima et al. |
| 2009/0296515 | A1 | 12/2009 | Ezaki et al. |

FOREIGN PATENT DOCUMENTS

| | | | |
|---|---|---|---|
| EP | 0 916 724 | A1 | 5/1999 |
| FR | 1 217 610 | A | 5/1960 |
| GB | 543995 | A | 3/1942 |
| JP | 10-043642 | | 2/1998 |
| JP | 2002-336667 | | 11/2002 |
| JP | 2003-306304 | | 10/2003 |
| JP | 2005-034075 | | 2/2005 |
| JP | 2005-041732 | | 2/2005 |
| JP | 2005-126260 | | 5/2005 |
| JP | 2007-187470 | | 7/2007 |
| JP | 2007-196218 | A | 8/2007 |
| JP | 2007-211641 | | 8/2007 |
| JP | 2008-93564 | A | 4/2008 |
| JP | 2008-133545 | A | 6/2008 |
| KR | 10-2006-0111068 | | 10/2006 |
| WO | WO 2007/096383 | A1 | 8/2007 |

OTHER PUBLICATIONS

Extended European Search Report dated May 18, 2011 in corresponding European application No. 10250709.2, listing the cited references, 7 pages.

SIPO Office Action dated Jun. 20, 2012 in corresponding Chinese application No. 201010108431.1 (9 pages), listing cited references in this IDS.

Japanese Office Action dated Mar. 29, 2011 of the Japanese Patent Application No. 209-215571, which claims priority of the corresponding Korean Priority Application No. 10 2009-0047348, 3 pages.

Chinese Office action for Application No. 201010108431.1, issued Feb. 5, 2013, 8 pages.

English translation of Chinese Office action for Application No. 201010108431.1, issued Feb. 5, 2013, 10 pages.

* cited by examiner

MIXING DEVICE

CROSS-REFERENCE TO RELATED APPLICATIONS

This application claims priority to and the benefit of Korean Patent Application No. 10-2009-0047348, filed on May 29, 2009, in the Korean Intellectual Property Office, the entire content of which is incorporated herein by reference.

BACKGROUND OF THE INVENTION

1. Field of the Invention

An aspect of the present invention relates to a mixing device capable of mixing a plurality of fluids.

2. Description of the Related Art

A mixing device or mixing component for mixing a plurality of fluids can be categorized as either an agitator or a static mixer. The agitator allows fluids to be mixed using an impeller moved by an electric power. The static mixer performs a mixing process using a helical element installed in a mixing space. Here, the helical element performs functions including flow division, rotational circulation, radial mixing and the like.

SUMMARY OF THE INVENTION

An aspect of an embodiment of the present invention is directed toward a mixing device which mixes a plurality of fluids and has high durability, high efficiency and system miniaturization capability.

According to an embodiment of the present invention, there is provided a mixing device including: a housing having an inner space and at least one opening for allowing at least two kinds of fluids to flow into the inner space; at least one pair of nozzle holes passing through one side wall of the housing; and at least one pair of guide portions extending from an outer surface of the housing and protruding up to the respective nozzle holes so that mixed fluids respectively discharged through the at least one pair of nozzle holes collide with each other.

In one embodiment, at least one of the guide portions is configured to allow a direction of a fluid discharged from a corresponding nozzle hole of the nozzle holes to be changed at from about 45 to about 90 degrees with respect to a direction normal to the outer surface of the housing. The pair of nozzle holes may be configured to collide the mixed fluids respectively discharged through the pair of nozzle holes with each other at an interior angle between about 90 and about 180 degrees.

In one embodiment, the guide portions are integrally formed with the housing. A first guide portion of the guide portions may have an embossed shape structure extending from the outer surface of the housing. The first guide portion may have a thickness substantially identical to that of the one side wall of the housing. One side of the first guide portion may be formed by cutting away a portion of the embossed shape structure to form a corresponding nozzle hole of the nozzle holes. The one side of the first guide portion may have a line plan view shape, an arc plan view shape and/or a square plan view shape.

In one embodiment, the housing has a flat plate shape. The one side wall through which the at least one pair of nozzle holes passes through may be a main side wall of the housing formed in the flat plate shape. The nozzle holes may include four pairs of nozzle holes arranged on respective quadrants about the center of the one main surface of the main side wall of the housing.

In one embodiment, the at least two kinds of fluids include water and a hydrocarbon-based fuel. The at least one opening may include first and second openings for allowing the water and the hydrocarbon-based fuel to flow into the interior space. The mixing device may be configured to flow in the water in a steam state and to flow in the hydrocarbon-based fuel in a gas state. The inner space may have a capacity between about 10 and about 500 cc. The mixing device may further include an evaporation portion for allowing the water to be changed from a liquid phase to a vapor phase. The evaporation portion and the inner space may be integrally formed in the housing with a partition wall interposed therebetween.

In one embodiment, a first nozzle hole of the nozzle holes is formed to have a circular shape, and the first nozzle hole has a diameter between about 1 and about 3 mm.

In one embodiment, the housing is formed of an aluminum alloy material.

According to aspects of embodiments of the present invention, fluids discharged through different nozzle holes collide with each other, so that at least two kinds of fluids can be efficiently mixed even when a mixing device has a small capacity. Further, a nozzle-function-portion (a nozzle hole or a combination of a nozzle hole and a guide portion) is formed through a simple process such as press working without separate installation of a high-price nozzle device, thereby saving manufacturing cost. Further, an existing metallic material having high durability is used, thereby ensuring and/or easily improving the durability of the mixing device without too much additional cost. Further, different kinds of fluids are uniformly mixed, thereby improving the entire efficiency of a system (e.g., a reformer or fuel cell power generating system) having the mixing device.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
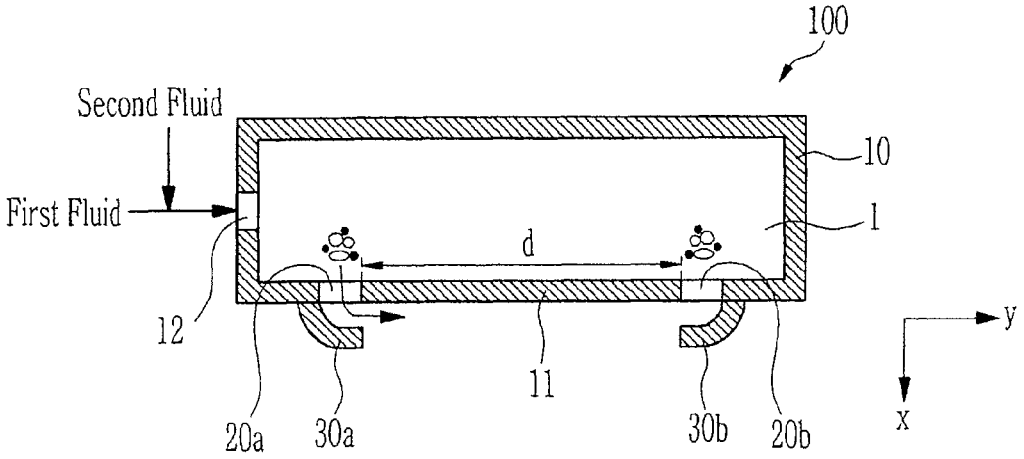
FIG. 1 is a schematic sectional view of a mixing device according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements. In the drawings, the thicknesses and sizes of elements are exaggerated for clarity.

FIG. 1 is a schematic cross-sectional view of a mixing device according to an embodiment of the present invention.

Referring to FIG. 1, the mixing device 100 includes a housing 10 provided with an inner space 1 into which a first fluid and a second fluid different from the first fluid are flowed; a pair of nozzle holes 20*a* and 20*b* formed at one side 11 of the housing 10; and a pair of guide portions 30*a* and 30*b* extending and protruding up to the respective nozzle holes 20*a* and 20*b* from the outer surface of the one side 11 of the housing 10.

The housing 10 has at least one opening 12 through which the first and second fluids are flowed into the inner space 1. The housing 10 may be formed in the shape of a polygon plate, a disk, etc.

The pair of nozzle holes 20*a* and 20*b* are spaced apart from each other at a distance (or a predetermined distance) d. The one side 11 of the housing 10 includes any suitable one of circumference walls defining the inner space 1. When the housing 10 is formed to have a flat plate shape, the one side 11 may be any suitable one of two sides having the largest area.

When a first mixed fluid is discharged from the inner space 1 and out of the mixing device 100 through the pair of nozzles 20*a* and 20*b*, the pair of guide portions 30*a* and 30*b* function to allow the first mixed fluid to be discharged in two directions with different angles and allow the discharged fluids to collide with each other.

In one embodiment of the present invention, a first mixed fluid refers to a fluid that results from the mixing of the first and second fluids. In one embodiment, the first mixed fluid is initially in a state in which the first and second fluids are not uniformly mixed, for example, due to the small capacity of the inner space 1.

According to the aforementioned mixing device 100, the first and second fluids are primarily mixed in the inner space 1 and then discharged out of the mixing device 100 through the pair of nozzle holes 20*a* and 20*b*. Here, the directions of the discharged fluids are guided by the pair of guide portions 30*a* and 30*b* respectively, and the discharged fluids collide with each other, so that the first and second fluids are mixed again, i.e., are secondarily mixed. Accordingly, the first and second fluids discharged from the mixing device 100 are substantially uniformly mixed and supplied even when the capacity of the inner space 1 is small.

In one embodiment of the present invention, the capacity of the housing 10 or the volume of the inner space 1 is unsuitable for allowing the first and second fluids to be mixed uniformly. For example, in a mixing device for supplying a fuel and water to a steam reforming type reformer, the capacity of a housing may be substantially identical to the amount of first and second fluids supplied per second or at least about 10 times larger than the amount of first and second fluids supplied per second. Here, the mixing device is a mixing device for mixing 600 standard cubic centimeters per minute (sccm) of a vapor hydrocarbon-based fuel and 6 sccm of the water. In one embodiment, the capacity of the housing may be between about 10 and 500 cc.

In one embodiment of the present invention, if the capacity of the housing 10 is between about the amount of the first and second fluids supplied per second and about 10 times larger than the amount of the first and second fluids supplied per second, the fluids are, nevertheless, well mixed and discharged while not increasing the volume of a fluid supply device for supplying the first fluid and/or the second fluid, even though the capacity of the inner space 1 in the mixing device 100 is a capacity unsuitable for mixing the first and second fluids to be mixed uniformly. Accordingly, mixing efficiency can be improved, and it is possible to promote miniaturization.

Also, in one embodiment, if the capacity of the housing 10 is less than the amount of the fluids supplied per second, it is substantially difficult to allow the fluids flowed into the inner space 1 to be uniformly mixed and supplied, even though the structure and arrangement of the guide portions 30*a* and 30*b*, which have been described above and will be described in more detail below, are utilized. In another embodiment, if the capacity of the housing 10 is larger than about 10 times the amount of the fluids supplied per second, the capacity or pressure of the fluid supply device is necessarily increased so that the pressure in the mixing device 100 is maintained constant. Therefore, it is not suitable for efficiency and miniaturization of the device.

Figure 2A:
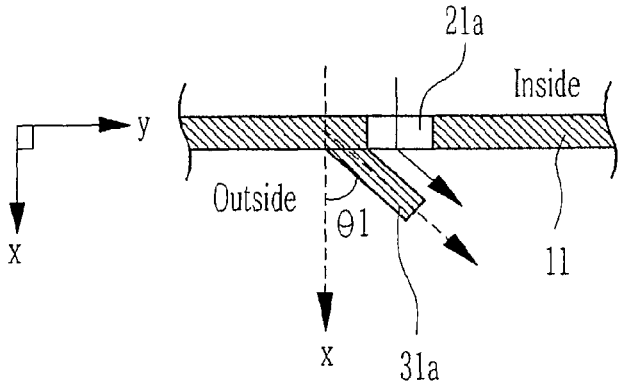
FIGS. 2A and 2B are partially enlarged sectional views illustrating nozzle holes and guide portions in a mixing device according to embodiments of the present invention.
Figure 2B:
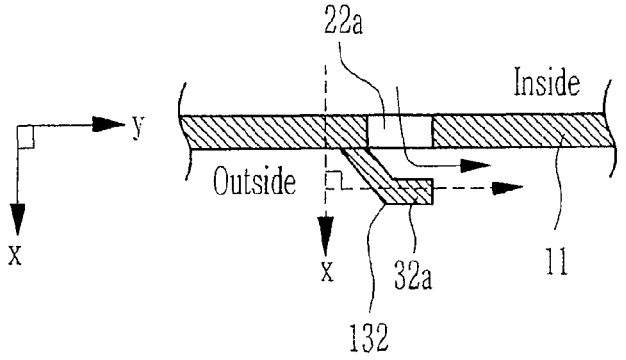

FIGS. 2A and 2B are partially enlarged cross-sectional views illustrating nozzle holes and guide portions in a mixing device according to embodiments of the present invention.

Referring to FIG. 2A, in one embodiment of the present invention, a housing of a mixing device includes one side 11; a nozzle hole 21*a* formed at the one side 11 of the housing; and a guide portion 31*a* extending up to the nozzle hole 21*a* from the outer surface of the one side 11 of the housing and covering the nozzle hole 21*a*. In this embodiment of the present invention, the one side 11 of the housing and the nozzle hole 21*a* may correspond to the one side 11 and the nozzle hole 20*a* in the mixing device of FIG. 1, respectively.

The guide portion 31*a* extends at a constant angle with respect to a second direction x perpendicular to a first direction y. That is, the guide portion 31*a* may have structure in which one end (or one side) of the guide portion 31*a* is fixed to the one side 11 of the housing, and the other end (or the other side) of the guide portion 31*a* extends while making a constant angle θ1 (hereinafter, referred to as a first angle) with the second direction x. The first angle θ1 is the mixed-fluid-guide-angle of the guide portion 31*a* and selected to be between about 45 and 90 degrees. The guide portion 31*a* may be formed by performing press working with respect to a portion of the one side 11 or by attaching a separate member to the one side 11.

In one embodiment, if the first angle θ1 is less than 45 degrees, a distance is increased. Here, the distance refers to a space between the one side 11 and a point at which first mixed fluids discharged through the nozzle hole 21*a* and another nozzle hole (not shown) making a pair with the nozzle hole 21*a* collide with each other. In other words, since the collision point of the first mixed fluids becomes too distant (or too far) from the nozzle hole, a collision force is weak, and therefore, the effect of fluid mixture is decreased.

In one embodiment, if the first angle θ1 is greater than 90 degrees, it is difficult to form the guide portion 31*a*. In the structure of the guide portion 31*a*, since the first mixed fluid discharged through the nozzle hole 21*a* collides with the outer surface of the one side 11 of the housing, the effect of fluid mixture caused by collision of the first mixed fluids cannot be obtained. Further, in such a structure, since the first mixed fluid discharged from an inner space is in the state that the first mixed fluids are not uniformly mixed, the first mixed fluids are discharged in the unequal mixture state.

As illustrated in FIG. 2B, in another embodiment of the present invention, a guide portion 32*a* may have a bent portion 132 so that the aforementioned constant angle substantially has 90 degrees or an angle approximate to 90 degrees. The guide portion 32*a* having the bent portion 132 may include a shape bent in an arc shape (or a shape having many bent portions to form a schematic arc shape) that is similar to the guide portion 30*a* of FIG. 1.

According to one embodiment of the present invention, first mixed fluids discharged through nozzle holes collide with each other at a position close to the outer surface of one side 11 of a housing. Here, the collision force of the first mixed fluids becomes greatest, and accordingly, the effect of fluid mixture can be increased or maximized.

Figure 3A:
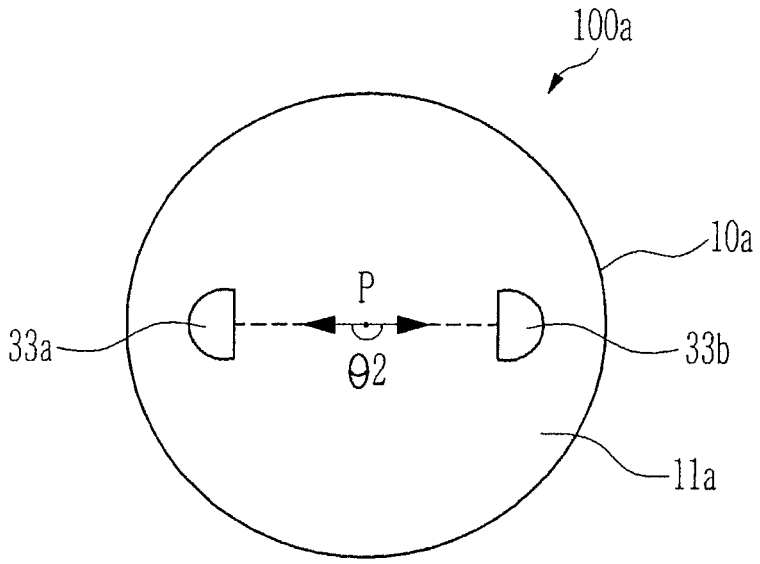
FIGS. 3A and 3B are schematic plan views illustrating arrangements of guide portions in a mixing device according to embodiments of the present invention.
Figure 3B:
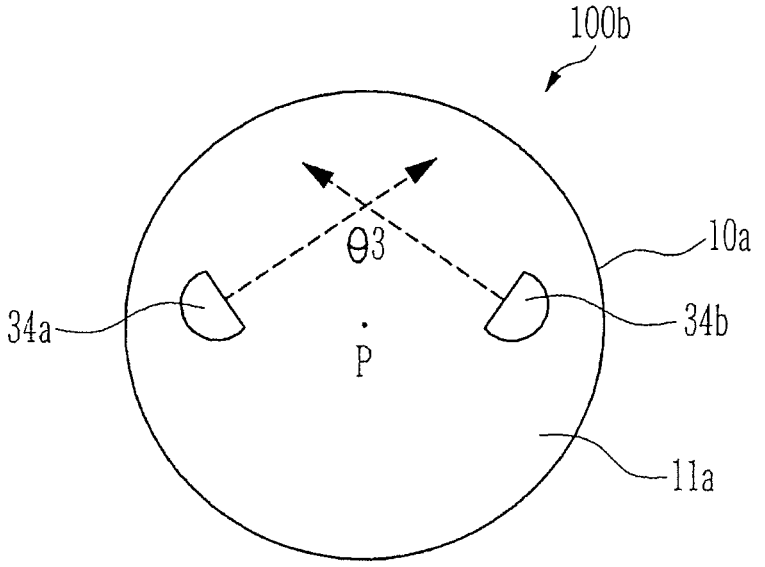

FIGS. 3A and 3B are plan views illustrating arrangements of guide portions in a mixing device according to embodiments of the present invention. The plan view of FIG. 3A may correspond to a bottom view of FIG. 1.

Referring to FIG. 3A, in one embodiment of the present invention, a mixing device 100*a* includes a flat cylindrical (or disk shape) housing 10*a* provided with an inner space having a size (or a predetermined size) in the interior of the mixing device 100*a*; a pair of nozzle holes formed at one side 11*a* of the housing 10*a*; and a pair of guide portions 33*a* and 33*b* respectively extending up to the pair of nozzle holes from the outer surface of the one side 11*a* of the housing 10*a*. In this embodiment, the structures and arrangements of the nozzle holes and the guide portions 33*a* and 33*b* may correspond to the nozzle holes 20*a* and 20*b* and the guide portions 30*a* and 30*b* in the mixing device 100 of FIG. 1.

The pair of guide portions 33*a* and 33*b* are arranged facing each other and having the central point P of the circular outer surface of the one side 11*a* therebetween. That is, the angle θ2 (hereinafter, referred to as a second angle) at which first mixed fluids respectively discharged through the pair of nozzle holes collide with each other is about 180 degrees. Accordingly, the first mixed fluids respectively discharged through the pair of nozzle holes are discharged in directions opposite to each other by the pair of guide portions 33*a* and 33*b*. Here, the collision force of the first mixed fluids becomes greatest, and accordingly, the first mixed fluids are uniformly mixed while colliding with each other.

In addition, in another embodiment of the present invention, the arrangement of the pair of guide portions may be modified as illustrated in FIG. 3B. That is, a pair of guide portions 34*a* and 34*b* may be arranged so that the angle θ3 (hereinafter, referred to as a third angle or an interior angle) at which first mixed fluids respectively discharged through the pair of nozzle holes collide with each other is between about 90 and 180 degrees. According to the embodiment of the present invention, the first mixed fluids respectively discharged through the pair of nozzle holes are discharged in directions crossing each other by the guide portions 34*a* and 34*b*, so that the first mixed fluids are uniformly mixed while colliding with each other.

If the third angle θ3 is smaller than 90 degrees, the collision point of the first mixed fluids respectively discharged through the pair of nozzle holes becomes distant from the nozzle holes. Therefore, a collision force is weak, and the effect of fluid mixture may be decreased.

Figure 4A:
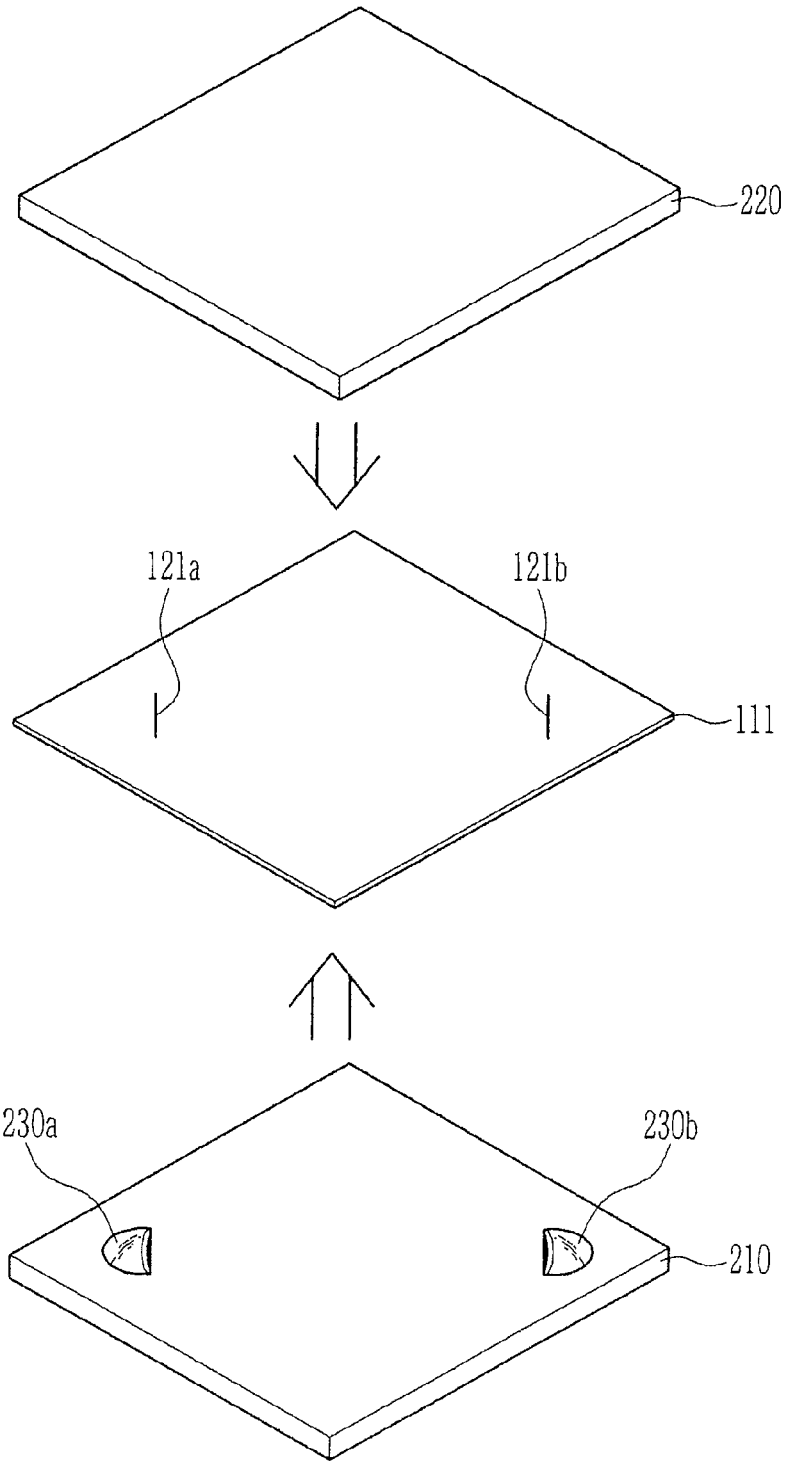
FIGS. 4A and 4B are schematic perspective views sequentially illustrating processes of manufacturing a mixing device according to an embodiment of the present invention.
Figure 4B:
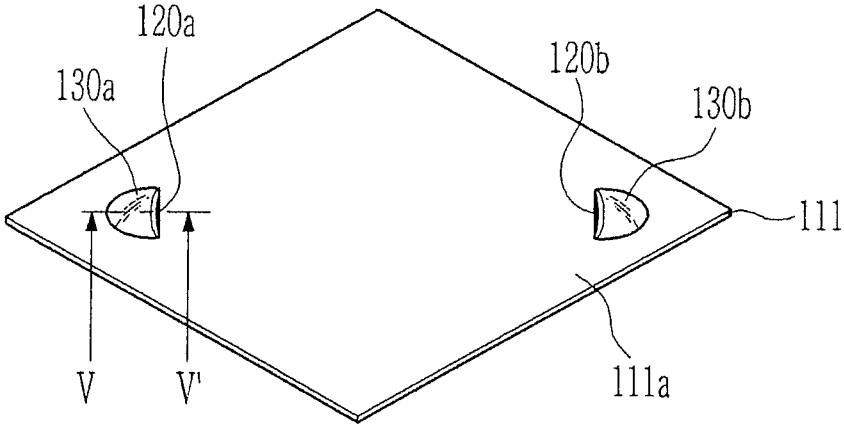

FIGS. 4A and 4B are schematic perspective views sequentially illustrating processes of manufacturing a mixing device according to an embodiment of the present invention. In one embodiment of the present invention, processes of manufacturing nozzle holes and guide portions, which are major portions of the mixing device, will be described in more detail hereinbelow.

As illustrated in FIG. 4A, a plate member 111 is first prepared. Here, the plate member 111 is used as one side of the mixing device. The material of the plate member 111 may include a material subjected to cutting or molding. For example, the material of the plate member 111 may include an aluminum alloy having high durability and/or thermal conductivity. Next, cut-away portions 121*a* and 121*b* having a constant length are formed at the plate member 111. The cut-away portions 121*a* and 121*b* are formed at positions where nozzle holes and guide portions are to be formed, respectively.

Subsequently, the plate member 111 is press-molded using a press tool having lower and upper dies 210 and 220. Here, first irregular portions 230*a* and 230*b* are formed at one side of the lower die 210 so that portions of the plate member 111 adjacent to the cut-away portions 121*a* and 121*b* are press-molded. Second irregular portions making a pair with the first irregular portions 230*a* and 230*b* may be formed at one side of the upper die 220 (one side opposite to or facing the one side of the lower die 210 having the first irregular portions 230*a* and 230*b*).

As illustrated in FIG. 4B, a pair of guide portions 130*a* and 130*b* and a pair of nozzle holes 120*a* and 120*b* are formed at the press-molded plate member 111. Here, the pair of guide portions 130*a* and 130*b* are formed to protrude in an embossed shape on one outer surface 111*a* of the plate member 111.

The press-molded plate member 111 is cut to a suitable size and then welded. For example, the plate member 111 may be used as one circumference wall of the housing in the mixing device of FIG. 1.

Figure 5:
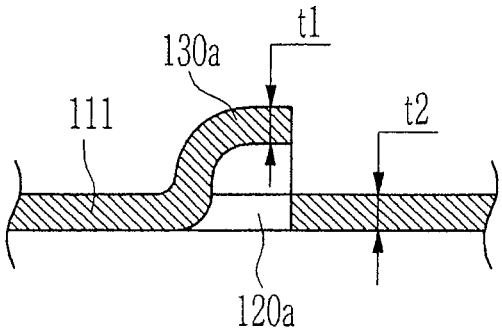
FIG. 5 is a partial sectional view of a plate member taken along line V-V' of FIG. 4B.

FIG. 5 is a partial cross-sectional view of a plate member taken along line V-V' of FIG. 4B.

As illustrated in FIG. 5, the guide portion 130*a* may be molded to have a thickness t1 substantially identical to the thickness t2 of the plate member 111 because of properties of the plate member 111 including plasticity, malleability, ductility and the like. In this embodiment, the nozzle hole 120*a* and the guide portion 130*a* may correspond to the nozzle hole 20*a* and the guide portion 30*a* of FIG. 1, respectively.

FIGS. 6A to 6D are partial plan views illustrating different shapes of a guide portion in a mixing device according to the present invention.

In embodiments of the present invention, a guide portion is formed to protrude on an outer surface 111*a* of a plate member 112 forming one side of a housing. When viewed in a direction (hereinafter, referred to as a z-direction) toward the outer surface 111*a*, the shape of a cut-away portion of the guide portion may have a line, inequality sign or arc shape. The guide portion having a line-shaped cut-away portion may refer to the guide portions of FIGS. 1 to 5.

Figure 6A:
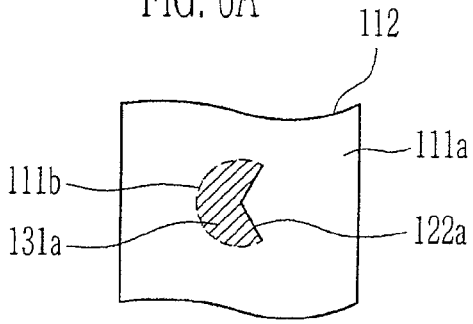
FIGS. 6A to 6D are partial plan views illustrating different shapes of a guide portion in a mixing device according to embodiments of the present invention.

More specifically, in one embodiment, when viewed in the z-direction, a guide portion 131*a* may have the shape of an inequality sign (<) with one end 111*b* integrally coupled with a plate member 112 while covering a nozzle hole like a roof as illustrated in FIG. 6A. Further, the guide portion 131*a* may have the other end 122*a* cut away from the plate member 112. In this case, the size of the nozzle hole formed at the plate member 112 together with the guide portion 131*a* is schematically identical to that of the diagonally lined portion in FIG. 6A.

Figure 6B:
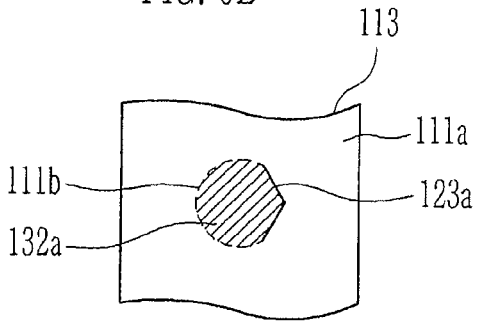

In another embodiment, when viewed in the z-direction, a guide portion 132*a* may have the shape of an inequality sign (>) with one end 111*b* integrally formed with a plate member 113 while covering a nozzle hole like a roof as illustrated in FIG. 6B. Further, the guide portion 132*a* may have the other end 123*a* cut away from the plate member 113. In this case, the size of the nozzle hole formed at the plate member 113 together with the guide portion 132*a* is schematically identical to that of the diagonally lined portion in FIG. 6B.

Figure 6C:
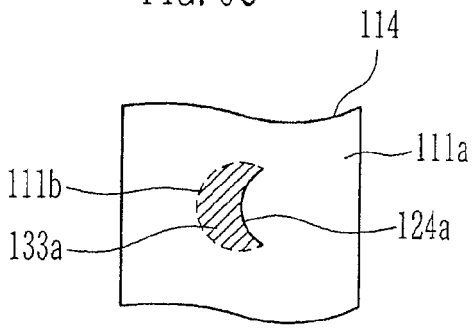

In still another embodiment, when viewed in the z-direction, a guide portion 133*a* may have the shape of a concave arc with one end 111*b* integrally formed with a plate member 114 while covering a nozzle hole like a roof as illustrated in FIG. 6C. Further, the guide portion 133*a* may have the other end 124*a* cut away from the plate member 114. In this case, the size of the nozzle hole formed at the plate member 114 together with the guide portion 133*a* is schematically identical to that of the diagonally lined portion in FIG. 6C.

Figure 6D:
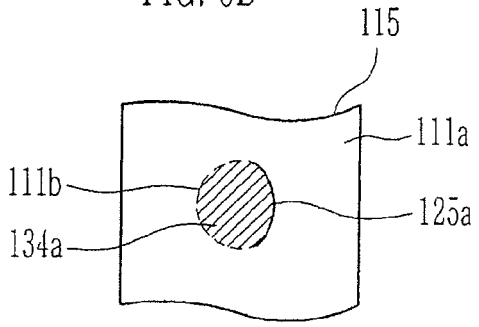

In still another embodiment, when viewed in the z-direction, a guide portion 134*a* may have the shape of a convex arc with one end 111*b* integrally formed with a plate member 115 while covering a nozzle hole like a roof as illustrated in FIG. 6D. Further, the guide portion 134*a* may have the other end 125*a* cut away from the plate member 115. In this case, the size of the nozzle hole formed at the plate member 115 together with the guide portion 134*a* is schematically identical to that of the diagonally lined portion in FIG. 6D.

In the aforementioned embodiments, when a nozzle hole is formed in a circular shape, the diameter of the nozzle hole may be between about 1 and 3 mm. In one embodiment, if the diameter of the nozzle hole is smaller than the range, the pressure in an inner space of the mixing device may be increased. In another embodiment, if the diameter of the nozzle hole is greater than the range, it is difficult to serve as a nozzle for spraying a first mixed fluid. In addition, the aforementioned range may be adjusted to increase when the capacity of the inner space of the mixing device is increased.

Figure 7:
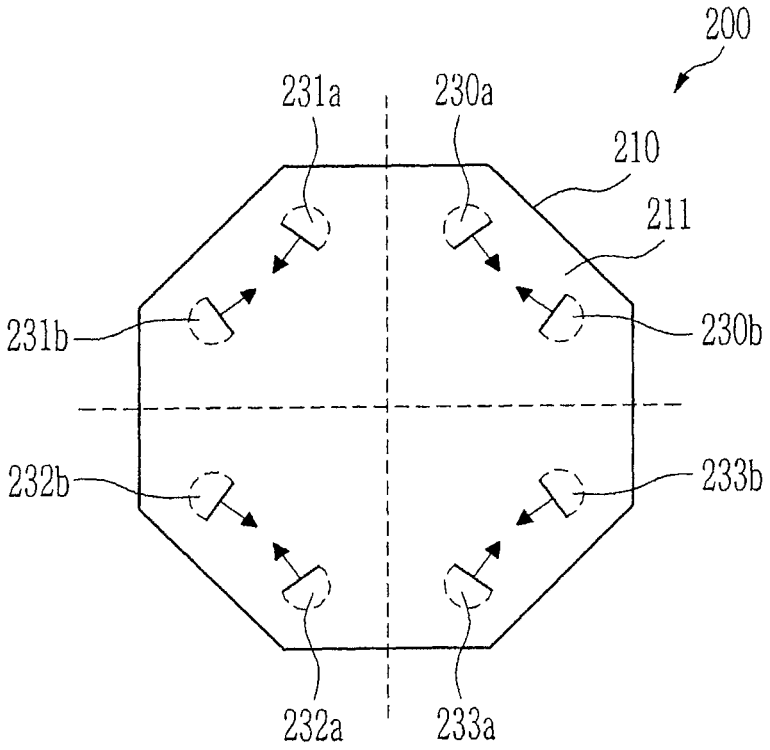
FIG. 7 is a schematic plan view of a mixing device according to another embodiment of the present invention.

FIG. 7 is a schematic plan view of a mixing device according to another embodiment of the present invention.

Referring to FIG. 7, the mixing device 200 includes a housing 210; a first pair of nozzle holes, a second pair of nozzle holes, a third pair of nozzle holes and a fourth pair of nozzle holes, formed at one side 211 of the housing; and a first pair of guide portions 230*a* and 230*b*, a second pair of guide portions 231*a* and 232*b*, a third pair of guide portions 232*a* and 232*b* and a fourth pair of guide portions 233*a* and 233*b*, formed to correspond to the respective pairs of nozzle holes. Each of the pairs of guide portions are arranged so that first mixed fluids respectively discharged from each of the pairs of nozzle holes collide with each other.

The mixing device 200 may have plural pairs of nozzle holes and plural pairs of guide portions, which means that the degree of freedom can be improved in the design and manufacture of the mixing device. Further, the size and number of plural pairs of nozzle holes and plural pairs of guide portions are controlled, so that it is possible to appropriately control pressure in the mixing device while obtaining the effect of fluid mixture caused by collision.

Figure 8:
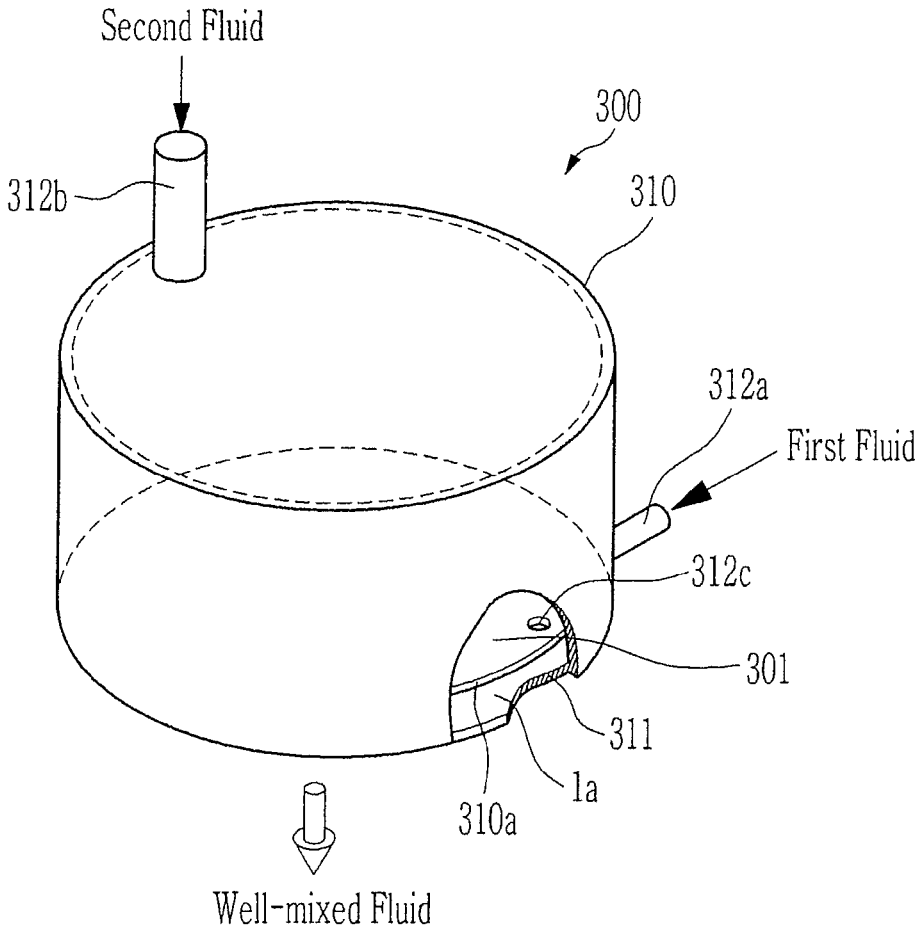
FIG. 8 is a schematic perspective view of a mixing device according to still another embodiment of the present invention.

FIG. 8 is a schematic perspective view of a mixing device according to still another embodiment of the present invention.

Referring to FIG. 8, the mixing device 300 according to the embodiment of the present invention includes a housing 310, an evaporation portion 301, and one or plural pairs of the aforementioned nozzle holes and guide portions (see FIGS. 1 and 7).

In one embodiment, the evaporation portion 301 is disposed in the housing 310 together with an inner space la in which at least two kinds of fluids are stored. In the housing 310, the evaporation portion 301 is separated from the inner space 1 by a partition wall 310*a*. The evaporation portion 301 allows at least one of the at least two kinds of fluids to be changed from a liquid phase into a vapor phase. The evaporation portion 301 may have a heater coupled to the interior and/or exterior of the housing 310. The heater may include an electric heater.

At least a pair of nozzle holes are disposed to pass through one side 311 of the housing 310. At least a pair of guide portions extends and protrudes up to the nozzle holes from the outer surface of the one side 311, corresponding to the respective pair of nozzle holes.

The operation of the mixing device 300 will be described in more detail below.

A first vapor fluid is flowed into the inner space 1*a* through a first inlet 312*a*. A second liquid fluid is flowed into the evaporation portion 301 through a second inlet 312*b*. In the evaporation portion 301, the second fluid is changed from a liquid phase to a vapor phase. The second vapor fluid is flowed into the inner space la through a passage 312*c* passing through the partition wall 310*a*.

The first and second fluids are primarily mixed in the inner space 1*a*. Here, the volume or capacity of the inner space la is designed to be small in accordance with a need for miniaturization. Therefore, it is difficult to allow the first and second fluids to be uniformly mixed in the inner space 1*a*.

A first mixed fluid having unequally mixed first and second fluids is discharged through the nozzle holes passing through the one side 311 of the housing 310. At this time, the first mixed fluids discharged through the nozzle holes by the guide portions covering the nozzle holes collide with each other. The first and second fluids in the first mixed fluid are secondarily mixed due to the collision. That is, the first and second fluids discharged from the mixing device 300 can be uniformly mixed and supplied to a system.

Meanwhile, it has been described in the aforementioned embodiments that two nozzle holes make a pair and two guide portions make a pair. However, the present invention is not limited to the aforementioned configuration. If first mixed fluids respectively discharged from three or more nozzle holes approximately collide with one another at one point, the three or more nozzle holes may form a group. In this case, three or more guide portions respectively corresponding to the three or more nozzle holes may form a group.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A mixing device comprising:

a housing having an inner space and first and second openings for allowing water and a hydrocarbon-based fuel to flow into the inner space;

at least one pair of nozzle holes passing through one side wall at a bottom inner surface of the housing; and at least one pair of guide portions extending from a bottom outer surface of the housing and protruding with a constant angle away from the bottom outer surface of the housing to cover the respective nozzle holes such that mixed fluids respectively discharged through the at least one pair of nozzle holes are discharged to an outside of the mixing device, guided by the guide and collide with each other, wherein at least one of the guide portions is configured to allow a direction of fluid discharged to the outside of the mixing device from a corresponding nozzle hole of the nozzle holes to be changed at from about 45 to about 90 degrees with respect to a direction normal to the outer surface of the housing, and wherein the fluids discharged from each of the respective nozzle holes collide with each other outside of the mixing device such that the fluids discharged from each of the nozzle holes are mixed again outside of the bottom surface of the mixing device.

2. The mixing device according to claim 1, wherein the pair of nozzle holes are configured to collide the mixed fluids respectively discharged through the pair of nozzle holes with each other at an interior angle between about 90 and about 180 degrees.

3. The mixing device according to claim 1, wherein the guide portions are integrally formed with the housing.

4. The mixing device according to claim 3, wherein the guide portions have a thickness substantially identical to that of the one side wall of the housing.

5. The mixing device according to claim 1, wherein the housing has a flat plate shape.

6. The mixing device according to claim 5, wherein the one side wall through which the at least one pair of nozzle holes passes through is a main side wall of the housing formed in the flat plate shape.

7. The mixing device according to claim 6, wherein the nozzle holes comprise four pairs of nozzle holes arranged on respective quadrants about the center of the one main surface of the main side wall of the housing.

8. The mixing device according to claim 1, wherein the mixing device is configured to flow in the water in a steam state and to flow in the hydrocarbon-based fuel in a gas state.

9. The mixing device according to claim 8, wherein the inner space has a capacity between about 10 and about 500 cc.

10. The mixing device according to claim 8, further comprising an evaporation portion for allowing the water to be changed from a liquid phase to a vapor phase.

11. The mixing device according to claim 10, wherein the evaporation portion and the inner space are integrally formed in the housing with a partition wall interposed therebetween.

12. The mixing device according to claim 1, wherein a first nozzle hole of the nozzle holes is formed to have a circular shape, and the first nozzle hole has a diameter between about 1 and about 3 mm.

13. The mixing device according to claim 1, wherein the housing is formed of an aluminum alloy material.

14. A mixing device comprising:

a housing having an inner space and first and second openings for allowing water and a hydrocarbon-based fuel to flow into the inner space;

at least one pair of nozzle holes passing through one side wall at a bottom inner surface of the housing; and at least one pair of guide portions extending from a bottom outer surface of the housing and protruding with an acute angle away from the bottom outer surface of the housing to cover the respective nozzle holes such that mixed fluids respectively discharged through the at least one pair of nozzle holes are discharged to an outside of the mixing device, guided by the guide and collide with each other, wherein at least one of the guide portions is configured to allow a direction of fluid discharged to the outside of the mixing device from a corresponding nozzle hole of the nozzle holes to be changed at from about 45 to about 90 degrees with respect to a direction normal to the outer surface of the housing, and wherein the fluids discharged from each of the respective nozzle holes collide with each other outside of the mixing device such that the fluids discharged from each of the nozzle holes are mixed again outside of the bottom surface of the mixing device.

* * * * *